United States Patent [19]

Hartwig

[11] Patent Number: 4,724,806

[45] Date of Patent: Feb. 16, 1988

[54] LUBRICANT CIRCULATION SYSTEM

[75] Inventor: Carl S. M. Hartwig, Taby, Sweden

[73] Assignee: Atlas Copco Aktiebolag, Stockholm, Sweden

[21] Appl. No.: 27,801

[22] Filed: Mar. 19, 1987

[30] Foreign Application Priority Data

May 13, 1986 [SE] Sweden ..... 8602168

[51] Int. Cl.[4] ..... F01M 1/00

[52] U.S. Cl. ..... 123/196 A; 184/6.13; 210/416.5; 210/168; 210/232

[58] Field of Search ..... 123/196 A, 196 R; 417/360; 210/416.5, 168, 232, 258; 184/6.13, 6.24

[56] References Cited

U.S. PATENT DOCUMENTS

| | | | |
|---|---|---|---|
| 1,380,276 | 5/1921 | Ward | 184/6.13 |
| 2,706,905 | 4/1955 | Wilson | 210/416.5 |
| 3,087,582 | 4/1963 | Potter | 184/6.24 |
| 3,926,281 | 12/1975 | Hannibal | 184/6.24 |
| 4,075,099 | 2/1978 | Pelton et al. | 123/196 A |
| 4,131,396 | 12/1978 | Privon | 184/6.24 |

*Primary Examiner*—E. Rollins Cross

*Attorney, Agent, or Firm*—Eric Y. Munson

[57] ABSTRACT

A lubricant circulation system for an automotive vehicle in which a filter and container unit (23) is used. This unit can be unscrewed and be replaced with another one so that both lubricant and filter (24) can be quickly replaced.

1 Claim, 1 Drawing Figure

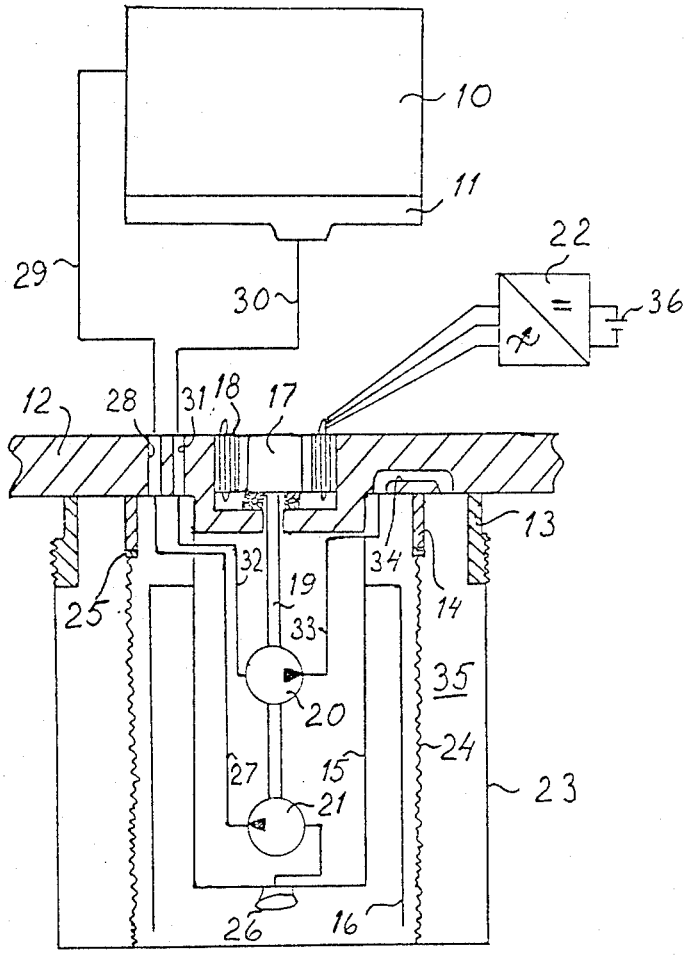
10
11
22
36
29
30
12
28
31
18
17
13
32
34
19
14
25
33
35
20
24
27
15
23
21
26
16

LUBRICANT CIRCULATION SYSTEM

The present invention relates to a lubricant circulation system for an automotive vehicle.

Normal prior art internal combustion engines are provided with a fairly big oil sump for storing the oil used as lubricant. The oil is circulated by an oil pump through an oil filter to the different lubrication points and back to the sump. A drawback with this prior art system is that a bottom plug has to be removed when oil is to be replaced. The oil is collected in a receptacle. Then the bottom plug is put back and new oil is poured in through an opening on top of the engine. Because of the service life of modern oils the oil filter should be replaced when the oil is changed. The whole procedure is time-consuming and dirty because it is more or less unavoidable that some oil, used or fresh, is spilt during the procedure.

The present invention, which is defined in the appended claim, aims at doing away with the above mentioned drawbacks by providing a lubricant circulation system where the oil container and oil filter are provided in a common unit which is made such that it can be pushed over the oil pump and secured to some structure on the vehicle. In this way oil and oil filter are quickly replaced in a single operation where no oil need be spilt.

An embodiment of the invention is described below with reference to the accompanying drawing which schematically shows a lubricant circulation system.

The embodiment of the invention shown in the drawing comprises an internal combustion engine being provided with a lubricant collecting zone in form of an oil sump 11. The engine is mounted on an automotive vehicle, e.g. a car. The vehicle is provided with a structure 12, which could be the engine, being provided with mounting means 13 having threads. The structure is also provided with a ring 14. An enclosure 15 is secured to structure 12 and provided with an annular skirt 16 which may be provided with a number of holes for the passage of lubricant. A brushless alternating current motor having a rotor 17 and a stator 18 is mounted on structure 12. The motor is provided with a shaft 19 for the driving of two lubricant pumps 20 and 21. A container 23 forms together with a filter 24 in the container a filter and container unit. The filter is at its upper end provided with a ring 25 for cooperation with ring 14 on structure 12. Container 23 is at its upper end provided with threads by means of which the filter and container unit is securable to mounting means 13. The shown engine 10 is provided with a so-called dry oil sump which means that it is small and continuously drained. If the oil container is placed anywhere but below the engine, which might be desirable, two oil pumps are needed as shown in the drawing. One oil pump 20 is used to drain the oil sump. The other pump 21 is used to supply the lubrication points with lubricant. Pump 21 sucks lubricant from the bottom of container 23 through inlet 26 and pushes the lubricant through conduit 27, channel 28 and conduit 29 to the lubrication points in engine 10. The lubricant then returns to the lubricant collecting zone 11 from where it is sucked through conduit 30, channel 31 and conduit 32 by pump 20. Pump 20 then pushes the lubricant through conduit 33 and channel 34 to space 35 between filter 24 and the wall of container 23. The shown electric motor is a three-phase brushless alternating current motor supplied with current from a voltage supply, here shown as a battery 36, via an inverter 22. The inverter preferably supplies the motor with high frequency current so that a multi-polar motor can be used in order to obtain a high power-to-weight ratio. Pump 20 should have a higher capacity than pump 21 in order to avoid accumulation of lubricant in sump 11.

I claim:

1. A lubricant circulation system for an automotive vehicle comprising an internal combustion engine (10) provided with a lubricant collecting zone (11), characterized in that a structure (12) on the vehicle is provided with mounting means (13) to which a filter and container unit (23) is securable, that said unit is provided with an open end through which a lubricant pump (21) can be entered into said unit, and that all lubricant connections (27,32,33) and the lubricant pump drive (19) are arranged on said structure (12).

* * * * *